United States Patent [19]

Port

[11] 4,030,240

[45] June 21, 1977

[54] CONVERTIBLE DOLL WITH PIVOTED CHANGEABLE HANDS

[76] Inventor: Beverly A. Port, 5098 E. Hillcrest, Port Orchard, Wash. 98366

[22] Filed: Apr. 19, 1976

[21] Appl. No.: 678,173

[52] U.S. Cl. ..... 46/153; 46/163; 46/173

[51] Int. Cl.² ..... A63H 3/12

[58] Field of Search ..... 46/153, 163, 164, 173

[56] References Cited

UNITED STATES PATENTS

| | | | |
|---|---|---|---|
| 1,346,953 | 7/1920 | Gould | 46/163 |
| 1,374,343 | 4/1921 | Wiener | 46/164 |
| 1,425,974 | 8/1922 | Kearney | 46/153 |
| 1,555,644 | 9/1925 | Duncan | 46/153 |
| 2,078,809 | 4/1937 | Richman | 46/153 X |
| 2,506,328 | 5/1950 | Alger | 46/173 X |

*Primary Examiner*—F. Barry Shay
*Attorney, Agent, or Firm*—Clarence A. O'Brien; Harvey B. Jacobson

[57] ABSTRACT

A doll convertible in appearance characteristics by utilizing body extremities which are provided with two separate appearance characteristics on the front and rear surfaces thereof with at least certain of the extremities being movable to expose to view a selected appearance characteristic. Each of the hands of the doll is in the form of a double hand pivotal about a transverse axis oriented generally at the wrist area to orient a selected hand in exposed condition at the end of the arm. Each leg of the doll may be provided with a pair of lower leg portions and corresponding feet pivotal about a transverse axis generally corresponding with the knee area to enable either of the lower leg portions and feet to be exposed. Alternatively, the leg may be swivelly supported for rotation about a longitudinal axis for reversing the position of the entire leg. The head may be stationary and provided with distinguishable characteristics on the front and rear or the head may be swivelled about a vertical axis and also capable of tilting universally to enable the head to be oriented in desired position for proper exposure of a face and hair assembly. The convertible doll may be constructed by utilizing various conventional doll manufacturing techniques with various different combinations of faces and limbs depicting human beings or animals having different appearance characteristics.

10 Claims, 9 Drawing Figures

Fig. 1
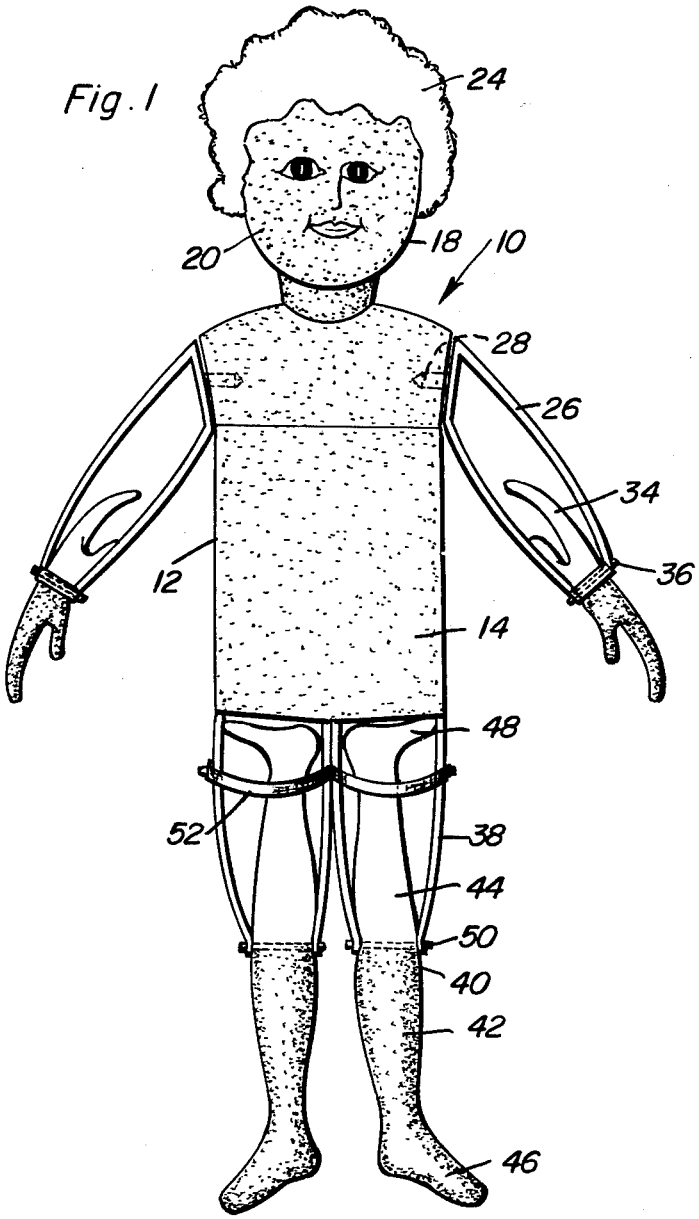
Fig. 2
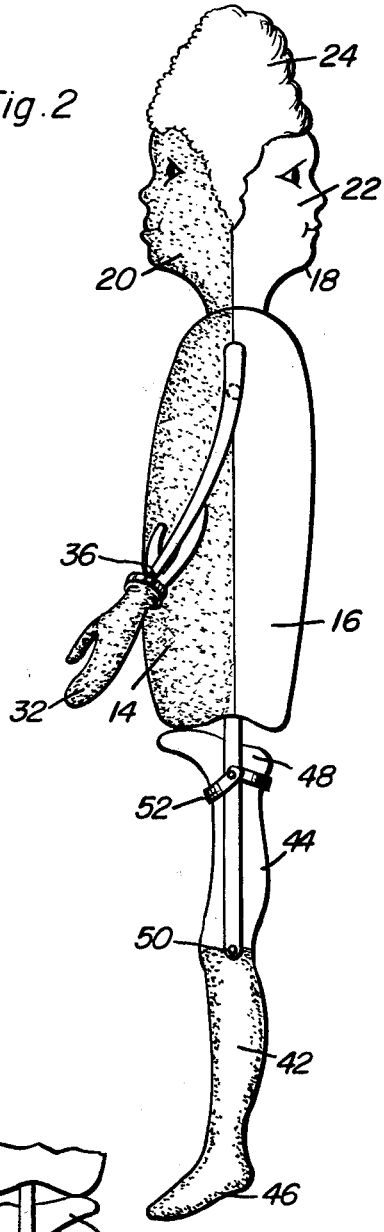
Fig. 5
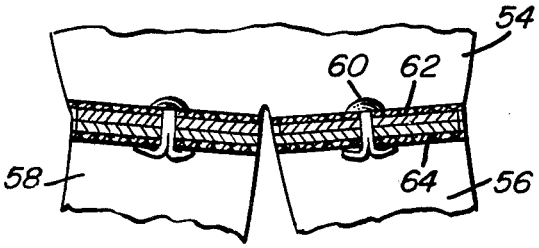
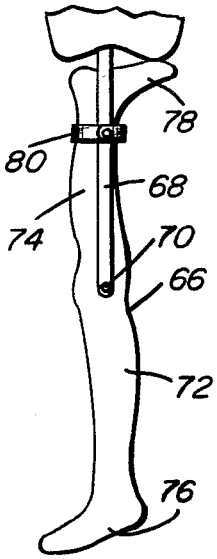
Fig. 6

CONVERTIBLE DOLL WITH PIVOTED CHANGEABLE HANDS

BACKGROUND OF THE INVENTION

1. Field of the Invention

The present invention generally relates to a convertible doll and more particularly a doll having a two face head, double hands and double feed and leg portions capable of being converted from a doll having one set of appearance characteristics to a doll having a different set of appearance characteristics.

2. Description of the Prior Art

Prior patents in this field of endeavor disclose dolls having different appearance characteristics in which the different characteristics are selectively exposed to view. U.S. Pat. No. 1,289,715 discloses a doll having front and rear appearance characteristics so that reversal of the doll changes the appearance characteristics. U.S. Pat. No. 1,396,766 issued Nov. 15, 1921, discloses a doll having a head on each each of the body with one of the heads being normally concealed by a depending skirt so that inversion of the doll will enable the appearance characteristics thereof to be changed. However, neither doll in this patent includes a complete set of arms with hands and legs with feet nor does either head swivel nor do the hands and legs pivot or switch. U.S. Pat. No. 1,425,974, issued Aug. 15, 1922, discloses a doll having different appearance characteristics on the front and rear surfaces thereof and a portion of the leg and foot can swivel at the knee. U.S. Pat. No. 1,966,986, issued July 17, 1934, discloses an invertible doll in which both ends of a body have a head with the lowermost head being concealed by a skirt. U.S. Pat. No. 2,396,441, issued Mar. 12, 1946, discloses a doll having different appearance characteristics on the front and rear thereof so that the different appearance characteristics can be observed by reversing the doll.

While the prior patents mentioned above disclose various structures in which the appearance characteristics of a doll may be changed by reversing, inverting or otherwise repositioning the doll, such devices do not enable total concealment of the set of appearance characteristics which are not being observed.

SUMMARY OF THE INVENTION

An object of the present invention is to provide a convertible doll having different appearance characteristics incorporated therein so that by movement of the doll and its appendages, the appearance characteristics of the doll can be completely altered with the doll being constructed in a conventional manner such as being sculptured, molded, formed of ceramic material or the like.

Another object of the invention is to provide a convertible doll with a movable two face head, double hands and double feet and lower leg portions in which the head may be rigid with the body, swivelly connected thereto or swivelly and pivotally connected thereto, the double hands are pivotally connected to the wrist portion of the arms for pivotal movement about a transverse axis and the legs are either pivotally mounted for movement about a transverse axis at the knee portion or swivelly mounted at the hip portion to enable reorientation of the appearance characteristics of the exposed components of the doll.

Still another object of the present invention is to provide a convertible doll in accordance with the preceding objects in which the variation in appearance characteristics may involve human beings of different races or appearance characteristics, animals, "monsters" or other objects in which it is desired to alter the appearance characteristics.

Still another object of the invention is to provide a convertible doll which is relatively simple in construction, highly simulative of humans or animals and relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front view of a doll without clothing illustrating the components of the doll oriented so that the doll has one set of appearance characteristics exposed.

FIG. 2 is a side elevational view of the construction of FIG. 1.

FIG. 5 is a fragmental sectional view illustrating an arrangement in which the legs are provided with a swivel joint adjacent the hip area.

FIG. 6 is a fragmental elevational view of another embodiment of the invention in which the leg portions are pivoted about a transverse axis at the knee joint.

DESCRIPTION OF THE PREFERRED EMBODIMENTS

Figure 3:
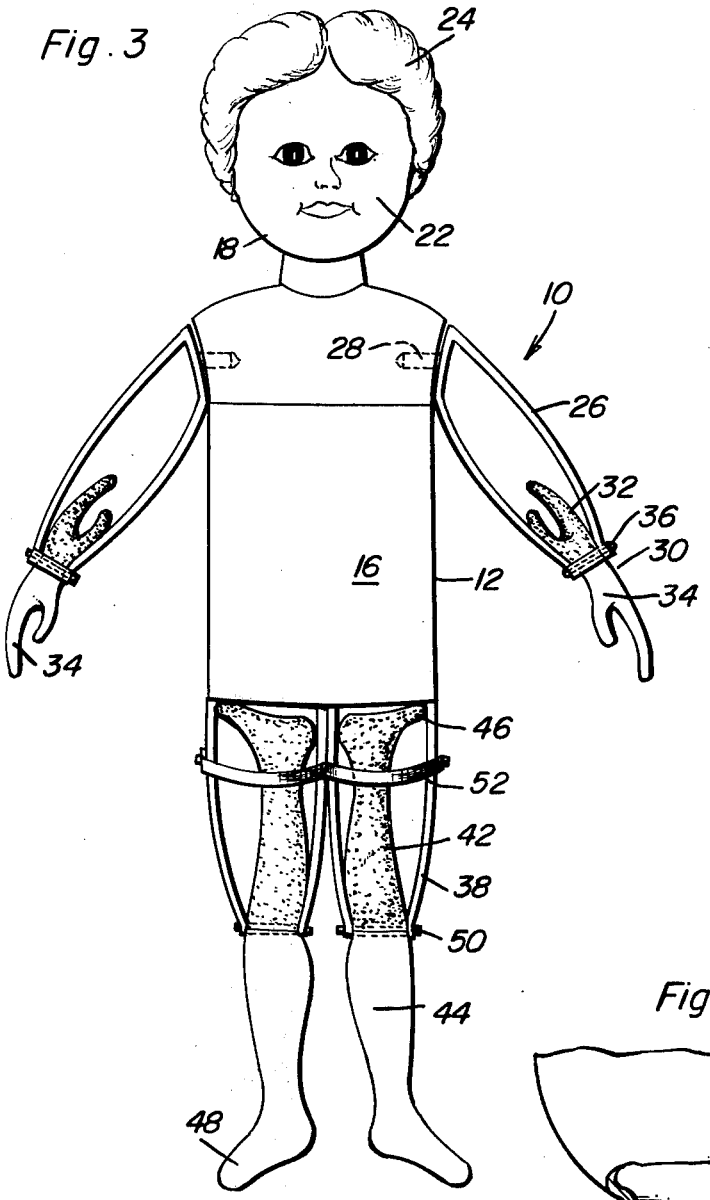
FIG. 3 is a front elevational view of the doll with the other set of appearance characteristics exposed.

Referring now specifically to the drawings, the doll of the present invention is generally designated by numeral 10 and includes a main body or torso 12 having distinguishable surface areas 14 and 16 with the distinction being in the surface ornamentation on the body. For example, the distinguishble characteristics may be contrasting colors, different finishes and the like. The body 12 may be constructed of various materials employing conventional procedures for constructing dolls. At the upper end of the body 12, a head 18 is mounted which also includes distinguisheable surface areas 20 and 22 and simulated hair or artificial hair 24 which may be oriented in different hair arrangements as illustrated in FIGS. 1 and 3 respectively.

Figure 4:
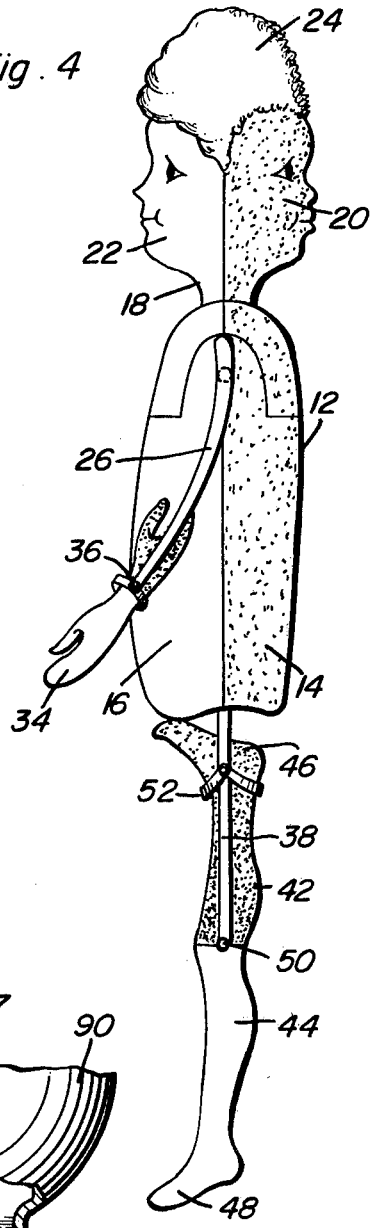
FIG. 4 is a side elevational view of the construction of FIG. 3.

Attached to the upper torso or body 12 at the shoulder region is a pair of arms 26 which are pivotally connected to the shoulder by a pivot pin 28 by which the arms may swing back and forth to a limited degree. Each of the arms 26 is in the form of a pair of bendable or rigid bars or straps that are spaced from each other and at the outer ends thereof and which generally are disposed at a wrist portion of the arm. FIGS. 2 and 4 illustrate the use of bendable bars or straps in the arms 26. If rigid bars or straps are used, the arms 26 would remain straight but pivot about pivot pin 28. A double pair of hands 30 are mounted for pivotal movement about a transverse axis so that hands 32 and 34 having distinguishable appearance characteristics may be pivoted to a position for observation. The double hands 30 are constructed so that either of the hands will fit between the straps or bars forming the arms 26 and a pivot bolt or pin 36 extends through the members 26 and the pair of hands 30 to pivot the same so that a selected hand 30 or 32 may be oriented in projecting relation to the arm 26 as illustrated in FIGS. 1 and 3 respectively. The pivot pin or bolt 36 may be provided with suitable friction producing capabilities to retain the extended hand in desired position and external garments or clothing mounted on the arm 26 would normally terminate at the wrist portion thus completely concealing the uppermost hand as well as the pivot bolt or pin 36.

Depending from the lower end of the body 12 is a pair of upper leg members 38 in the form of a pair of rigid straps or bars similar to the arms 26 with the lower ends of the legs 38 terminating at the knee portion and providing a support for a double leg and foot assembly 40 which includes lower leg portions 42 and 44 and feet 46 and 48 which are provided with distinguishable appearance characteristics in the same manner as the body, head and hands. The leg assembly 40 is pivoted between the lower ends of the straps or bars defining the upper legs 38 by a pivot bolt or pin 50 extending transversely at the knee region so that a selected lower leg portion and foot may be oriented in a downwardly extending relation as illustrated in FIGS. 1 and 3 respectively. An encircling strap 52 connected to the upper leg member 38 may be employed to secure the selected lower leg and foot in extended position. When a skirt, dress or the like is worn by the doll, the hem will normally be disposed at or below the knee portion to conceal the pivot pin or bolt 50 and the leg oriented upwardly of the knee portion.

FIG. 5 illustrates an alternative leg structure in which the body 54 is provided with two legs 56 and 58 which are of unitary construction from the hip area where they join with the body 54 to the feet (not shown). In this construction, the legs 56 and 58 are attached to the body 54 by a swivel connection 60 in the form of a rivet, bolt, pin or the like extending through the bottom wall 62 of the body 54 and the upper wall 64 of the leg 56. Thus, by constructing the front and rear surfaces of the leg and foot portion of the structure illustrated in FIG. 5 of cloth with the same appearance characteristics, neutral color or color to go with clothing, the appearance characteristics may be oriented in a desired position to go with any design head and to correspond with the position of the hands, body and head. This alternative structure for the legs enables the complete leg to be rotated about its longitudinal axis at the hip region thus eliminating the necessity of a garment enclosing the upper portion of the leg.

FIG. 6 illustrates another alternative leg structure 66 which includes the same type of upper leg member or bracket 68 as in FIGS. 1–4 as well as a tranverse pivot bolt or pin 70 defining a pivot axis for the leg member 66. The leg member 66 includes a pair of lower leg portions 72 and 74 with a foot 76 on the extreme end of the leg portion 72 and a foot 78 on the end of the leg portion 74 with the feet being oriented in opposite directions so that when the alternative position of the leg portions are used, the toe portions of both of the feet will point in the same direction rather than in opposite directions as in FIGS. 1–4. This enables selective orientation of the lower leg portions and feet in a downwardly extending relation to the leg bracket 68 without reversing the position of the head, body or hands. A retaining strap 80 attached to the leg bracket 68 releasably retains the leg member 66 in selected position. Also, the hands 26 may be reversed in the same manner as the feet in FIG. 6 so that either set of hands may be used with a stationary head.

Figure 7:
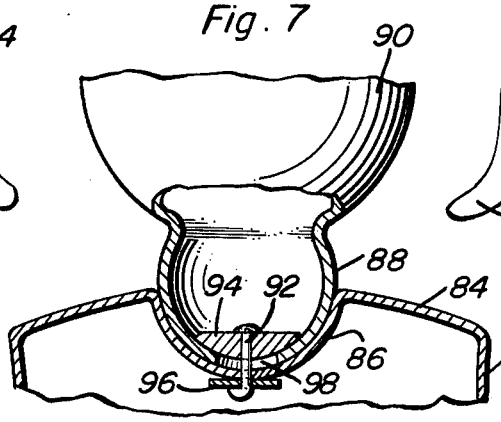
FIG. 7 is a fragmental sectional view illustrating a structure for enabling the head to swivel and pivot in relation to the main body.

FIG. 7 illustrates a head structure in which the body 82 is provided with a upper wall 84 having a generally semi-spherical recess 86 therein which receives a depending generally spherical, hollow projection 88 on the lower end of the head 90 which generally corresponds with the neck area. The spherical socket 86 and the spherical projection or ball 88 are in nested arrangement with a fastener 92 extending therethrough. The fastener 92 may be in the form of a rivet, bolt or the like and extends through a retaining plate 94 having a generally spherical lower surface which engages the interior of the hollow spherical member 88 and a washer or plate 96 at its lower end which has a concave spherical upper surface engaging the surface of the socket 88. This construction enables swivelling movement of the head 90 about a vertical axis generally defined by the fastener 92 and also, the enlarged apertures 98 in the socket and/or the spherical member 88 through which the fastener 92 passes, the head 90 may universally pivot or tilt in order to orient the head in a desired rotational and angular relation to the body.

Figure 8:
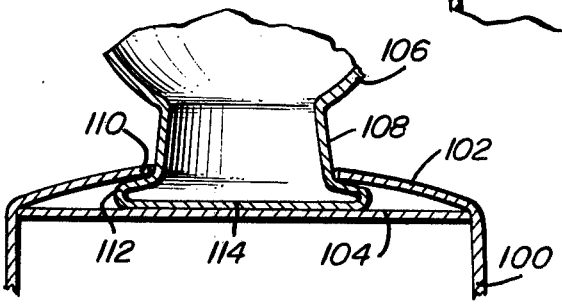
FIG. 8 is a fragmental sectional view illustrating an embodiment of the invention in which the head can swivel.

FIG. 8 illustrates another head construction in which the body 100 is provided with an upper wall 102 and a transverse generally horizontal partition 104 closely spaced under the upper wall 102. The head 106 is provided with a depending neck portion 108 which is generally cylindrical but flares outwardly and downwardly and extends through an opening 110 in the top wall 102. The neck portion 108 is provided with an outwardly flared lower end 112 terminating in a reversely curved peripheral edge and being closed by a bottom wall 114 which frictionally rests against the partition wall 104 as illustrated in FIG. 8. This construction enables swivelling movement of the head in relation to the body about substantially a vertical axis and the interfitting components may be constructed of yieldable plastic material to enable the outwardly flared lower end 112 to be inserted through the opening 110 or if rigid components are employed, the top wall 102 may be constructed of two pieces for assembly after the head and its flange portion 112 has been assembled on the partition wall 104 or any other assembly technique may be employed.

Figure 9:
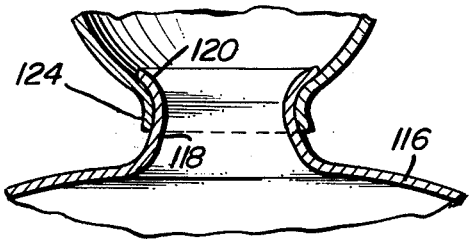
FIG. 9 is a fragmental sectional view illustrating another embodiment of the invention in which the head can swivel.

FIG. 9 illustrates another embodiment of the head structure in which the upper wall 116 of the body is provided with a hollow upturned projection 118 which terminates in an outwardly flared upper end 120 thus defining an upwardly extending neck portion having a generally peripheral concave external surface. The head 122 is provided with a downwardly extending hollow projection 124 which has a curved lower end defining a peripheral convex interior surface for engagement with the concave exterior surface of the upstanding projection 118 thereby providing for rotational movement of the head 122 about substantially a vertical axis. The arms 26 may be connected to each other through the body for extra security and depending on the type of materials used, the arms or brackets 26 can be attached to the body in various ways such as those shown in FIGS. 5 and 7–9. Also, the arms and legs can be attached to the bottom by short cloth sleeves between the body and arms and between the body and legs which will permit some articulation of the arms and legs.

The structure disclosed enables the doll to be converted by reversing the body and head, pivoting the hands and feet or swivelling the legs or by swivelling the head and correspondingly varying the other extremities. When clothing is placed on the doll, a realistic appearance characteristic can be obtained for each position of the components of the doll.

FIGS. 1–4 illustrate the basic doll construction with alternate methods of construction being shown in FIGS. 5–9. In each instance, the head will have two faces and the double hands will pivot about a transverse axis. Various color combinations, appearance characteristic combinations, hair styles, footwear and other articles of clothing may be provided to obtain a desired effect when the doll is converted. For example, one set of appearance characteristics may illustrate one race or ethnic group while the other set of appearace characteristics for the doll may illustrate another race or ethnic group. Likewise, the doll may depict different animals or monsters having somewhat similar body shape characteristics.

Various materials may be employed in constructing the doll including those which are conventionally employed to form the body, head, hair, eyes, and other components to closely simulate the person or animal which it depicts.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A convertible doll comprising a body having a head at the upper end and defining a shoulder region, waist region and hip region, arm members attached to the shoulder regions and leg members attached to the hip region, each arm member including a double hand at the outer end thereof with the two hands on each arm having distinguishable appearance characteristics, and means mounting the double hands for pivotal movement about a transverse axis intermediate the extermities of the hands to enable one of said hands to be positioned as a longitudinal extension of the arm member.

2. The structure as defined in claim 1 together with means for mounting the head on the shoulder region of the body to enable swivelling movement of the head about a substantially vertical axis.

3. The structure as defined in claim 2 wherein said means enabling swivelling movement of the head also including means enabling pivoting movement of the head.

4. The structure as defined in claim 1 wherein said head includes two faces having distinguishable appearance characteristics corresponding with the distinguishable characteristics of the double hands.

5. The structure as defined in claim 4 wherein said leg members include means attaching the upper end thereof to the body for swivelling movement about a longitudinal axis of the leg member with the front and rear surfaces of the leg member including distinguishable appearance characteristics corresponding with the appearance characteristics of the two faces on the head and the double hands.

6. The structure as defined in claim 4 wherein each of said leg members includes a pair of spaced depending brackets terminating at a knee region, a lower leg assembly including a pair of lower leg portions having a foot on each remote end thereof, and means pivotally mounting the lower leg assembly to the brackets for pivotal movement about a transverse axis at the knee region for selectively aligning a lower leg portion and foot with the leg member, said lower leg portions and feet including distinguishable appearance characteristics corresponding with the appearance characteristics of the faces on the head and double hands.

7. The structure as defined in claim 6 wherein the feet on the opposite ends of the lower leg assembly face in the same direction.

8. The structure as defined in claim 6 wherein the feet on the opposite ends of the lower leg assembly face in opposite directions.

9. The structure as defined in claim 4 together with means for mounting the head on the shoulder region of the body to enable swivelling movement of the head about a substantially vertical axis.

10. The structure as defined in claim 9 wherein each of said leg members includes a pair of spaced depending brackets terminating at a knee region, a lower leg assembly including a pair of lower leg portions having a foot on each remote end thereof, and means pivotally mounting the lower leg assembly to the brackets for pivotal movement about a transverse axis at the knee region for selectively aligning a lower leg portion and foot with the leg member, said lower leg portions and feet including distinguishable appearance characteristics corresponding with the appearance characteristics of the faces on the head and double hands.

* * * * *